US007341076B2

(12) United States Patent
Braekevelt et al.

(10) Patent No.: US 7,341,076 B2
(45) Date of Patent: Mar. 11, 2008

(54) WOVEN FABRIC COMPRISING LENO WEAVE BOUND METAL

(75) Inventors: Geert Braekevelt, Zwevegem (BE); Jeroen Gallens, Kortrijk (BE); Lode Puype, Waregem (BE)

(73) Assignee: NV Bekaert SA, Zwevegem (BE)

( * ) Notice: Subject to any disclaimer, the term of this patent is extended or adjusted under 35 U.S.C. 154(b) by 15 days.

(21) Appl. No.: 11/400,796

(22) Filed: Apr. 10, 2006

(65) Prior Publication Data

US 2007/0235595 A1 Oct. 11, 2007

(51) Int. Cl.
*D03C 7/00* (2006.01)
*D03D 15/02* (2006.01)
*D03D 19/00* (2006.01)

(52) U.S. Cl. ..... 139/50; 442/6; 442/228; 442/229

(58) Field of Classification Search ..... 139/50; 442/2, 6, 46, 47, 49, 198, 203, 219, 220, 442/228, 229
See application file for complete search history.

(56) References Cited

U.S. PATENT DOCUMENTS

| | | | | |
|---|---|---|---|---|
| 2,052,808 | A * | 9/1936 | Spokes | 442/190 |
| 3,481,371 | A * | 12/1969 | Row | 139/419 |
| 4,320,160 | A * | 3/1982 | Nishimura et al. | 428/107 |
| 4,425,398 | A * | 1/1984 | Berczi | 442/314 |
| 4,636,428 | A * | 1/1987 | Bruner et al. | 442/306 |
| 4,837,387 | A * | 6/1989 | van de Pol | 442/185 |
| 5,134,006 | A * | 7/1992 | Irvin | 428/68 |
| 5,191,777 | A * | 3/1993 | Schnegg | 66/195 |
| 5,552,207 | A * | 9/1996 | Porter et al. | 428/109 |
| 5,600,974 | A * | 2/1997 | Schnegg et al. | 156/148 |
| 5,752,550 | A * | 5/1998 | Scari' et al. | 139/420 C |
| 5,763,043 | A * | 6/1998 | Porter et al. | 428/109 |
| 5,807,793 | A * | 9/1998 | Scari et al. | 442/60 |
| 6,020,275 | A * | 2/2000 | Stevenson et al. | 442/60 |
| 6,429,153 | B1 * | 8/2002 | Welkers et al. | 442/35 |
| 6,706,376 | B1 * | 3/2004 | Von Fransecky | 428/212 |
| RE39,176 | E * | 7/2006 | Dutt | 442/43 |
| 7,111,882 | B2 * | 9/2006 | Corscadden et al. | 293/120 |
| 2004/0161990 | A1 * | 8/2004 | Leighton et al. | 442/164 |
| 2005/0082852 | A1 * | 4/2005 | Corscadden et al. | 293/120 |
| 2006/0013990 | A1 * | 1/2006 | Brentrup et al. | 428/102 |

FOREIGN PATENT DOCUMENTS

| | | | |
|---|---|---|---|
| DE | 1 556 132 | A1 | 1/1970 |
| DE | 31 36 026 | A1 | 3/1983 |
| DE | 195 30 541 | A1 | 2/1997 |
| EP | 0096929 | A1 | 12/1983 |
| EP | 0 464 803 | A1 | 1/1992 |
| FR | 2 214 001 | A | 8/1974 |
| WO | WO 97/07269 | A1 | 2/1997 |

* cited by examiner

*Primary Examiner*—Gary L. Welch
*Assistant Examiner*—Robert H Muromoto, Jr.
(74) *Attorney, Agent, or Firm*—Foley & Lardner LLP

(57) ABSTRACT

A woven fabric in which warp elements are provided out of metal. The fabric further comprising at least a first set of substantially parallel binding elements present in warp direction of the fabric. This first set of binding elements bind the warp elements to the weft elements by means of a leon weave at at least a part of the intersection points of warp and weft elements. The fabric as subject of the invention is characterized in that each binding element of the first set of binding elements crosses more than one warp element between consecutive intersection points bound by this binding element.

19 Claims, 6 Drawing Sheets

WOVEN FABRIC COMPRISING LENO WEAVE BOUND METAL

FIELD OF THE INVENTION

The present invention relates to a woven fabric comprising metal element such as steel cords, which woven fabric have warp elements and weft elements being bound to each other by means of a leon weave.

BACKGROUND OF THE INVENTION

Woven fabrics having warp elements and weft elements being bound to each other by means of a leon weave are known in the art.

Such woven fabrics comprising metal elements such as steel cords are known from e.g. EP96929B1.

The woven fabrics as described in EP96929B1 suffer however from several disadvantages.

A first disadvantage of these fabrics is the possible instability of the fabric. During production of the fabric, and during winding and unwinding, the fabric has the tendency to run out of alignment.

In order to prevent the fabric of curling, as shown in EP96929B1, adjacent warps having opposite directions of twisting are used. However, in case of metal cords, during production of the fabric, the metal cords have the tendency to move in its unwinding direction. As a result, adjacent warp elements having opposite twisting directions, may become displaced towards each other.

SUMMARY OF THE INVENTION

It is a subject of the present invention to provide a fabric which has not the disadvantages of prior art. It is further a subject of the present invention to provide a woven fabric comprising metal elements, in particular metal cords such as steel cords, which is stable in dimensions and which does not show the tendency to curl or run out of alignment.

The term "leon weave" is to be understood as the binding of a weft element, also often identified as "filling", to a warp element, due to the twisting of this warp element with a binding element. In order to obtain such bound, the binding element, running through the fabric in the warp direction of the fabric, is present at a given side of the warp element to be bound to the weft element at an intersection point of these warp and weft elements. Warp element and binding element are present at a first surface of the fabric, whereas the weft element to be bound is present at the opposite surface of the fabric. Following now the binding element in the warp direction, the binding element crosses the warp element in a first direction and then traverses through the fabric thickness towards the opposite side of the fabric. The binding element then crosses the weft element at the outer surface of the fabric. The binding element traverses again through the fabric to the same side of the warp element, and crosses the same warp element again, however in the opposite direction as was previously the case, in order to go to the consecutive intersection where warps and wefts are bound by this binding element. The effect is that weft and warp elements are bound to each other due to the crossing of the binding element in this order.

According to the present invention, at least a first set of binding elements cross more than one warp element, prior to binding a warp element to a weft element. Such binding element, being present in the warp direction of the fabric, is present at a given side of at least a first warp element and a second warp element. Warp elements and binding element are present at a first surface of the fabric, whereas the weft element, to be bound to this second warp element at an intersection point of this weft element and this second warp element, is present at the opposite surface of the fabric. Following now the binding element in the warp direction, the binding element crosses the first and at least the second warp elements in a first direction and then traverses through the fabric thickness towards the opposite side of the fabric. The binding element then crosses the weft element at the outer surface of the fabric. The binding element traverses again through the fabric to the same side of the second warp element, and crosses at least the second warp element again but in the opposite direction while going to the consecutive intersection point of warp elements and weft elements to be bound by this binding element. Most preferred, the binding element crosses at least the second and the first warp elements again in the opposite direction. Surprisingly it was found that the effect of crossing more than one warp element, is that it prevents the possibility of the fabric running out of alignment when winding or unwinding the fabric. This may be due to the fact of creating a diagonal link in the imaginary substantially rectangular figure determined by the two weft elements and the two warp elements bound by the binding element at consecutive intersection points.

Such binding element, being present in warp direction of the fabric, is present at a given side of at least a first and a second warp element. Warp elements and binding element are present at a first surface of the fabric, whereas the weft element, to be bound to this second warp element at an intersection point of this weft element and this second warp element, is present at the opposite surface of the fabric. Following now the binding element in warp direction, the binding element crosses the first and at least the second warp element in a first direction and then traverse trough the fabric thickness towards the opposite side of the fabric. The binding element then crosses the weft element at the outer surface of the fabric. The binding element traverse again through the fabric to the same side of the second warp element, and crosses at least the second warp element again but in opposite direction while going to the consecutive intersection point of warp elements and weft elements to be bound by this binding element. Most preferred, the binding element crosses at least the second and the first warp element again in opposite direction.

Surprisingly it was found that the effect of crossing more than one warp element, is that it prevents the possibility the fabric to run out of alignment when winding or unwinding the fabric. This may be due to the fact of creating a diagonal link in the imaginary substantially rectangular figure determined by the two weft elements and the two warp elements bound by the binding element at consecutive intersection points.

More advantageously it was found to have the binding element crossing two adjacent warp elements between consecutive intersection points bound by this binding element.

Further preference is given to woven fabrics as subject of the invention, comprising at least a second set of substantially parallel binding elements, which crosses at least one warp element and which may cross the warp elements in the opposite direction as compared to the first set of binding elements. Such presence of a second set of binding elements seem to prevent the warp elements to displace during production of the woven fabric. This is especially the case when at each of the intersection points bound by a binding element, at least a binding element of said first set of binding elements is present at a first side of the bound warp element, and a binding element of the second set of binding elements is present at the opposite side of the bound warp element.

Preference is given to the presence of a second set of substantially parallel binding elements, which crosses more than one warp element and which may cross the warp elements in the opposite direction as compared to the first set of binding elements. Preference is given to a second set of substantially parallel binding elements, which crosses an identical number of warp element as the binding elements of the first set of binding elements, preferably in opposite direction of the binding elements of the first set of binding elements.

The term "substantially parallel" binding elements is to be understood as a number of binding elements which follow a substantially equal path in the woven fabric, however being translated in weft direction over one or more warp positions.

It is understood that the first and second set of binding elements may differ from each other. The number of binding elements of the first set of binding elements may be less or equal to the number of binding elements of the second set of binding elements. Especially when the binding elements of the second set of binding elements cross only one warp element between consecutive intersection points being bound by this biding element, preference is given to a woven fabric comprising more binding elements in the second set of binding elements as compared to the first set of binding elements. In case the binding elements of both first and second set of binding elements cross an equal number of warp elements between consecutive intersection points being bound by the binding elements, preference is given to a first and a second set of binding elements comprising an equal number of binding elements.

In case the number of warp elements is less than or equal to the number of binding elements, such woven fabrics usually comprise intersection points of warp and weft elements being much firmly bound at the intersection points where both are bound by means of a binding element.

According to the present invention, at least a part of the intersection points between warp and weft elements are bound by means of a binding element. Possibly, although not necessarily, there may be intersection points between warp and weft elements were no binding element is present. At these intersection points, the warp and weft element may not be bound at all, or the warp and weft elements at such intersections may be interwoven.

According to the present invention, the warp elements are provided out of metal.

The warp elements may be metal wires, metal cords or a number of metal wires or metal cords being in contact with each other over the whole length of the wires or cords, acting so-to-say as twins in the woven fabric.

According to the present invention, the weft elements may be provided out of many different materials such as polyacid, polyamide, polyester, polyethyleneterephtalate, polypropylene, polyethylene, polyacrylic, glass, carbon, either as filaments, roving, cords, yarns, slivers, ribbons, tapes or bundles. Alternatively, roving, cords, yarns, slivers or bundles from natural or semi-natural fibers may be used. As an example, glass roving having a fineness ranging from 600 tex to 4800 tex, e.g. from 2400 tex to 4800 tex may be used. Alternatively, a glass multi-filament yarn having an optical diameter of about 1.5 mm is used. Alternatively a polyamide rope comprising 8 single yarns of each 1400 filaments plied together is used.

They may as well be provided out of metal such as metal cords or metal wires. Such metal weft elements may be metal wires, metal cords or a number of metal wires or metal cords being in contact with each other over the whole length of the wires or cords, acting so-to-say as twins in the woven fabric.

For both metal weft elements and metal warp elements, metal is to be understood as any type of metal, such as iron based alloys, steel stainless steel, high carbon steels, low carbon steels, but also e.g. copper.

For both metal weft elements and warp elements, the term "metal cord" is to be understood as a number of metal filaments being bunched or cabled with each other in order to form a cord, rope or strand.

Any type of cord construction may be used to provide the metal cords as used in the woven fabric as subject of the invention. Preferably however, n×m×D cords such as 4×7×D, 5×7×D, 6×7×D or 7×7×D cords are used, wherein n and m are integers and D is the nominal diameter of the filaments used to provide the construction. Possibly, different filament diameters are used in one cord, resulting in cords of construction n×(D1+(m−1)×D2), wherein D1 and D2 are mutually different filament diameters. Alternatively, n+m cords may be used, such as 1+6, 3+9 or 3+2-constructions. Possibly different filament diameters are used in one cord. By way of example, 5×0.8 High impact cord, of 0.225+18×0.22 cords may be used. Alternatively a 5×0.38 high impact cord or a 0.25+18×0.22 cord can be used.

The binding elements as subject of the invention may be provided out of such as polyacid such as Twaron®, Nomex® or Kevlar®, polyamide, polyester, pblyethyleneterephtalate, polypropylene, polyethylene, polyacrylic, glass, natural or semi-natural fiber based material either as filaments, roving, cords, yarns, slivers, ribbons, tapes or bundles. Alternatively also metal wires or metal cords may be used. Metal wires preferably have a diameter ranging between 0.01 and 035 mm, such as less than 0.2 mm.

Metal cords used as binding element are preferred to be flexible but fine. As an example a fine cord having a construction of 2×0.15 mm, 3×(3×0.04 mm) or 4×(7×0.1 mm) High Elongaton cord may be used.

It is understood that the distances in the woven fabric between adjacent warp elements and between adjacent weft elements may vary over a large extent. Preferably the distances or 'pitch' between adjacent warp or adjacent weft elements ranges from 0.5 mm to 40 mm, more preferred between 1 mm and 35 mm such as between 2 and 25 mm.

The woven fabric as subject of the invention may be used for several different applications. Especially the use of the woven fabric as a reinforcing member of a belt, such as a rubber or polymer belt, such as timing belts, hoisting belts, elevator belts, passenger belts, cover belts seems to benefit of the woven fabric as subject of the invention. The woven fabric as subject of the invention may also serve as a reinforcing member in impact absorbing structures such as impact beams, car body parts, bumper beams, concrete reinforcement tapes or fabrics, plies in rubber tires or span elements.

BRIEF DESCRIPTION OF THE DRAWINGS

The invention will now be described into more detail with reference to the accompanying drawings wherein.

DESCRIPTION OF THE PREFERRED EMBODIMENTS OF THE INVENTION

Figure 1:
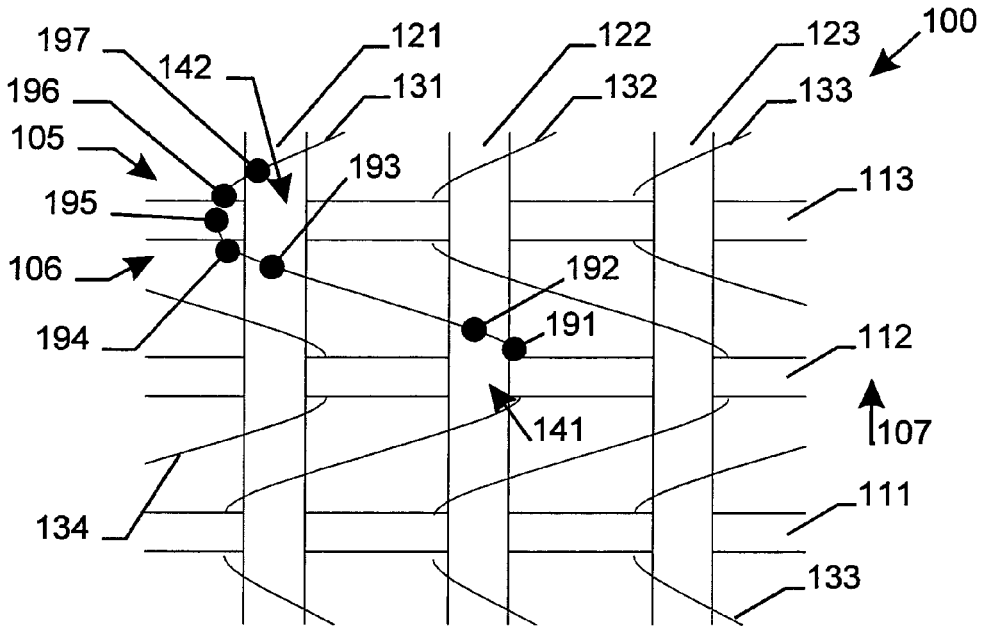
FIG. 1, FIG. 2, FIG. 3, FIG. 4, FIG. 5 and FIG. 6 show schematically woven fabrics as subject of the invention.

A woven fabric 100 as subject of the invention is shown in FIG. 1. The fabric 100 comprises weft elements (111, 112, 113) which are bound to warp elements (121, 122, 123) by means of one set of binding elements (131, 132, 133, 134) at each intersection point of a warp and a weft element.

At the intersection point 141, where warp element 122 and weft element 112 cross, the binding element 131 binds these warp and weft elements. At the consecutive intersection point 142, further in the warp direction 107 of the woven fabric 100, this binding element binds weft element 113 and warp element 121.

At point 191 of the binding element 131, the binding element 131 is at the right side of first warp element 121 and second warp element 121. When following the binding element 131 in the warp direction from point 191 onwards, the binding element 131 crosses warp elements 122 and 121 in this order in the left direction at points 192 and 193. At point 194, the binding element 131, present at the surface side 105 of the woven fabric, traverses through the fabric 100 towards the opposite side 106 of the fabric 100. The binding element 131 then crosses the weft element 113 at the outer surface of the fabric 100 at point 195. At point 196 the binding element 131 traverses again through the fabric 100 to the same side 105 of the second warp element 121. At point 197, the binding element 131 crosses at least the second warp element 121 again but in the opposite (right) direction while going to the consecutive intersection point of warp elements and weft elements to be bound by this binding element 131. So between two consecutive intersection points 141 and 142, bound by means of binding element 131, this binding element crosses two warp elements 121 and 122. As is shown, at each of the intersection points of the woven fabric 100, the warp and weft elements are bound by means of one binding element. The woven fabric has thus an identical number of warp elements and binding elements.

So between two consecutive intersection points 141 and 142, bound by means of binding element 131, this binding element crosses two warp elements 121 and 122.

As is shown, at each of the intersection points of the woven fabric 100, the warp and weft element is bound by means of one binding element. The woven fabric has thus an identical number of warp elements and binding elements.

Figure 2:
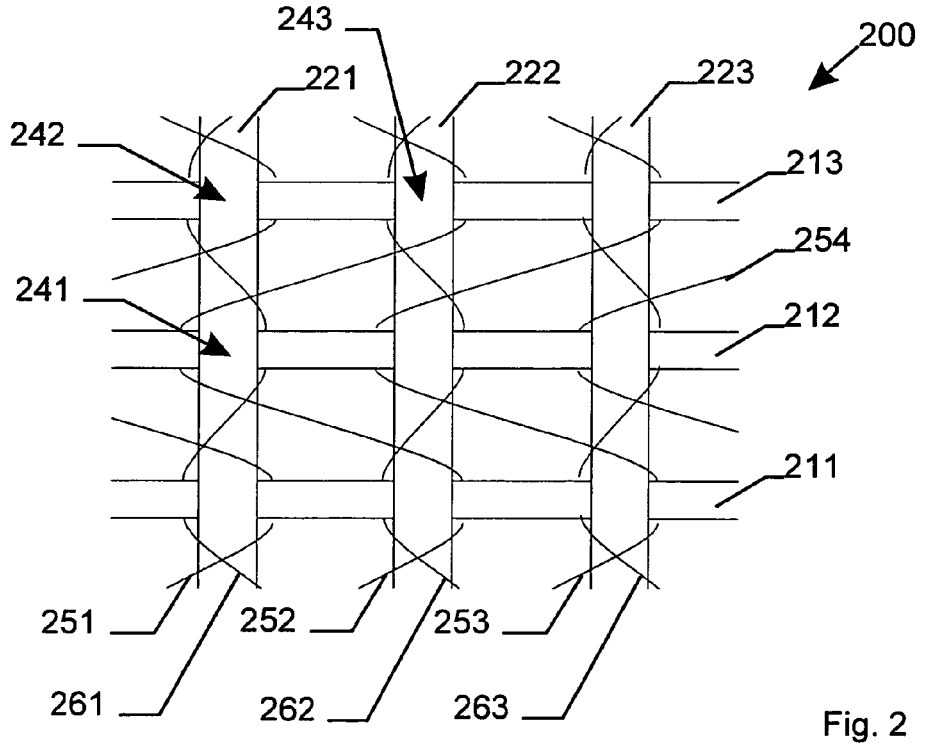

An other woven fabric 200 as subject of the invention is shown in FIG. 2. The fabric 200 comprises weft elements (211, 212, 213) which are bound to warp elements (221, 222, 223) by means of a first set of binding elements (251, 252, 253, 254) and a second set of binding elements (261, 262, 263).

As is shown, at each of the intersection points (241, 242, 243) of the woven fabric 200, the warp and weft element is bound by means of one binding element of the first set of binding elements (251, 252, 253, 254). At each intersection point, the warp and weft element is additionally bound by means of a binding element (261, 262, 263) of the second set of binding elements, binding warp and weft elements by means of a leon weave. Between two consecutive intersection points bound by the same binding element of the second set of binding elements, the binding element crosses only one warp element, in opposite direction as compared to the crossing direction of the binding elements of the fist set of binding elements. As an example, between intersection points 241 and 242, bound by the same binding element 261 of the second set of binding elements, the binding element 261 crosses only one warp element 221 in opposite direction as compared to the crossing direction of the binding elements 251 and 252 of the fist set of binding elements.

Between two consecutive intersection points bound by the same binding element of the first set of binding elements, the binding element crosses more than one, in this case two, warp element, in opposite direction as compared to the crossing direction of the binding elements of the second set of binding elements. As an example, between intersection points 241 and 243, bound by the same binding element 252 of the first set of binding elements, the binding element 252 crosses warp elements 221 and 222 in opposite direction as compared to the crossing direction of the binding elements 261 and 262 of the second set of binding elements.

In woven fabric 200 as subject of the invention, at each intersection point, a binding element of the first set of binding elements is present at a first side of the bound warp element, whereas a binding element of the second set of binding elements is present at the opposite side of this bound warp element. As an example, at intersection point 241, the binding element 252 of the first set of binding elements is present at the left side of the bound warp element 221, whereas the binding element 261 of the second set of binding elements is present at the right side of this bound warp element 221. The presence of a binding element at each side of the warp element, apparently restricts the displacement of the warp elements during production of the woven fabric 200, especially in case the warp elements (221, 222, 223) are metal cords such as steel cords.

Figure 3:
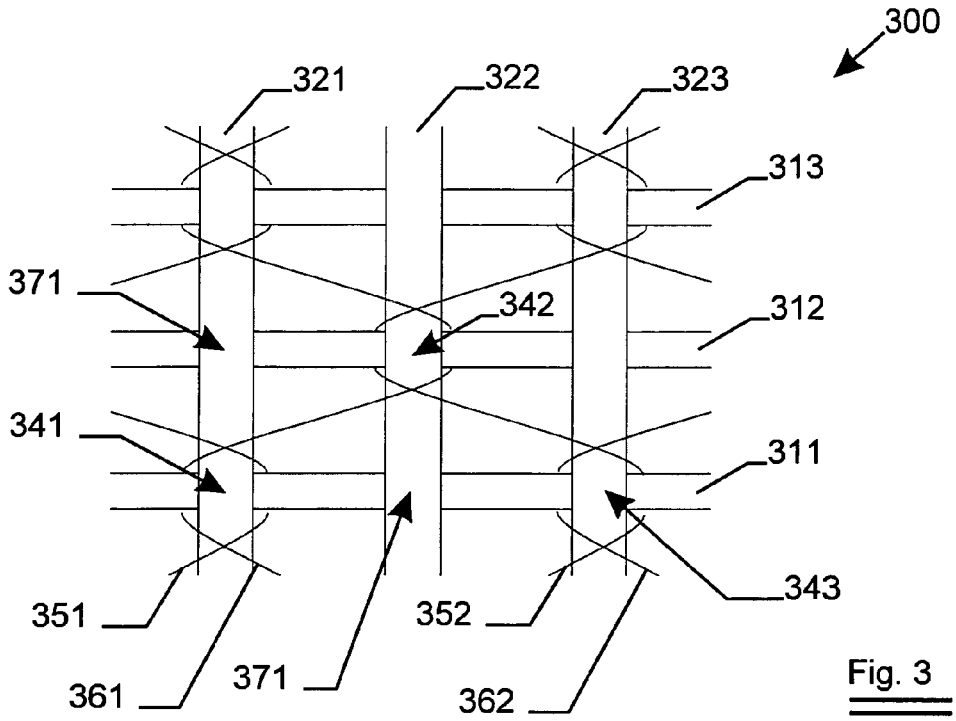

An other woven fabric 300 as subject of the invention is shown in FIG. 3. The fabric 300 comprises weft elements (311, 312, 313) which are bound to warp elements (321, 322, 323) by means of a first set of binding elements (351, 352) and a second set of binding elements (361, 362).

The woven fabric comprises intersection points (341, 342, 343) being bound by means of a leon weave, and intersection points (371) where warp element and weft element are not bound.

As is shown, at each of the leon bound intersection points of the woven fabric 300, the warp and weft element is bound by means of one binding element of the first set of binding elements (351, 352). At each leon bound intersection point, the warp and weft element is additionally bound by means of a binding element (361, 362) of the second set of binding elements, binding warp and weft elements by means of a leon weave. Between two consecutive intersection points bound by the same binding element of the second set of binding elements, the binding element crosses more than one, in this case two, warp elements, although in opposite direction as compared to the crossing direction of the binding elements of the fist set of binding elements. As an example, between intersection points 341 and 342, bound by the same binding element 361 of the second set of binding elements, the binding element 361 crosses warp elements 321 and 322 in opposite direction as compared to the crossing direction of the binding elements 351 and 352 of the fist set of binding elements.

Between two consecutive intersection points bound by the same binding element of the first set of binding elements, the binding element crosses an identical number of warp element as does the binding elements of the second set of binding elements, but in opposite direction as compared to the crossing direction of the binding elements of the second set of binding elements. As an example, between intersection points 343 and 342, bound by the same binding element 352 of the first set of binding elements, the binding element 352 crosses warp elements 323 and 322 in opposite direction as compared to the crossing direction of the binding elements 362 and 361 of the second set of binding elements.

Identical as in fabric 200, in woven fabric 300 as subject of the invention, at each leon bound intersection point, a binding element of the first set of binding elements is present at a first side of the bound warp element, whereas a binding element of the second set of binding elements is present at the opposite side of this bound warp element, which presence of a binding element at each side of the warp element, apparently restricts the displacement of the warp elements during production of the woven fabric 300, especially in case the warp elements (321, 322, 323) are metal cords such as steel cords.

In woven fabric 300, at the intersection points 371 not bound by means of a binding elements according to a leon weave, the warp and weft elements are not bound.

Figure 4:
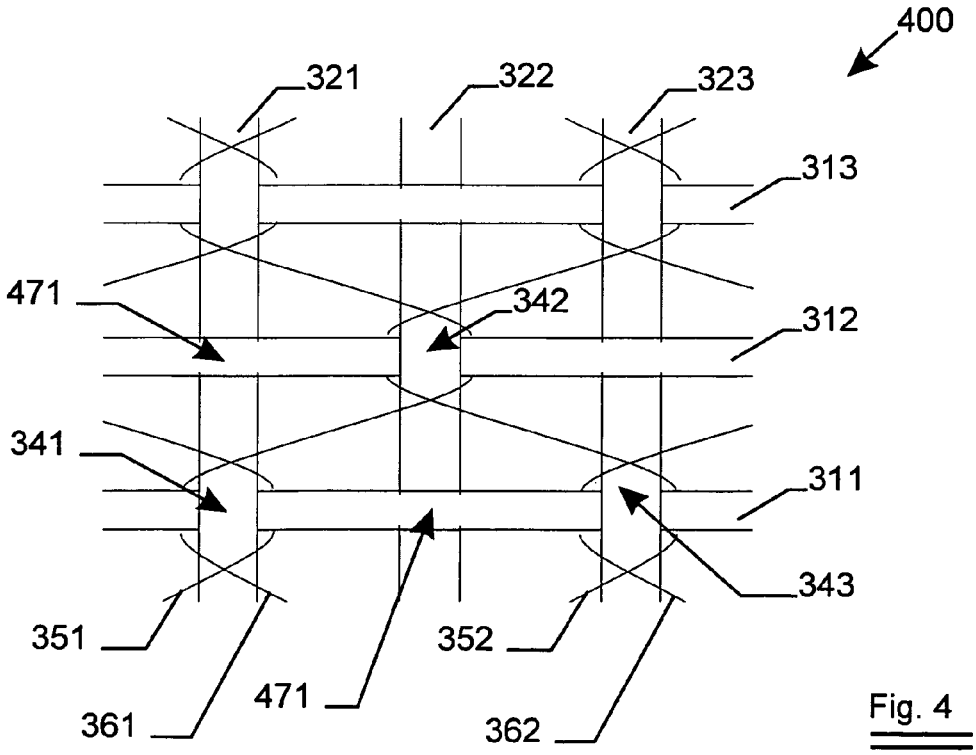

An alternative woven fabric 400 as subject of the invention is shown in FIG. 4. This fabric 400, for which reference numbers used in FIG. 3 correspond with identical features in FIG. 4, differs from the woven fabric of FIG. 3 at the intersection points which are not bound by means of a binding element according to a leon weave.

At intersection points 471, the warp and weft elements are interwoven with each other. The term "interweave" is to be understood that the warp end weft element, each being present in the woven fabric leon weave at one surface of the fabric, cross each other, meanwhile being present at the opposite surface of the woven fabric.

Figure 5:
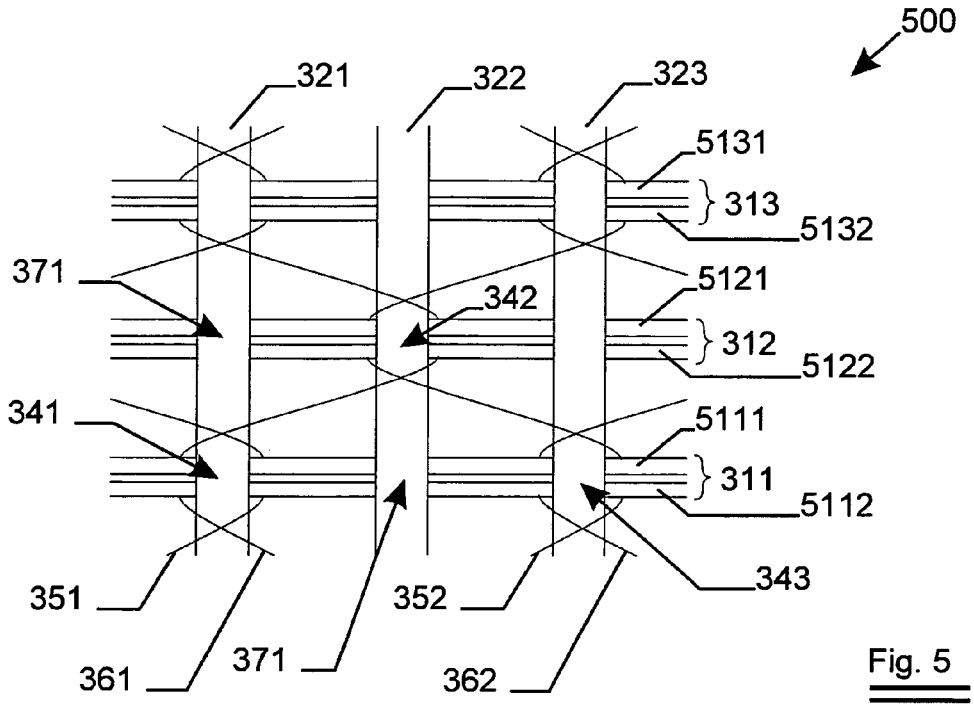

An alternative woven fabric 500 as subject of the invention is shown in FIG. 5. This fabric 500, for which reference numbers used in FIG. 3 correspond with identical features in FIG. 5, differs from the woven fabric of FIG. 3 by having weft elements which comprise on its turn more than one, e.g. such as shown two, substantially parallel metal wires or metal cords. As shown in FIG. 5, the weft element 311 comprises two essentially parallel metal wires or metal cords 5111 and 5112. The weft element 312 comprises two essentially parallel metal wires or metal cords 5121 and 5122. The weft element 313 comprises two essentially parallel metal wires or metal cords 5131 and 5132.

Figure 6:
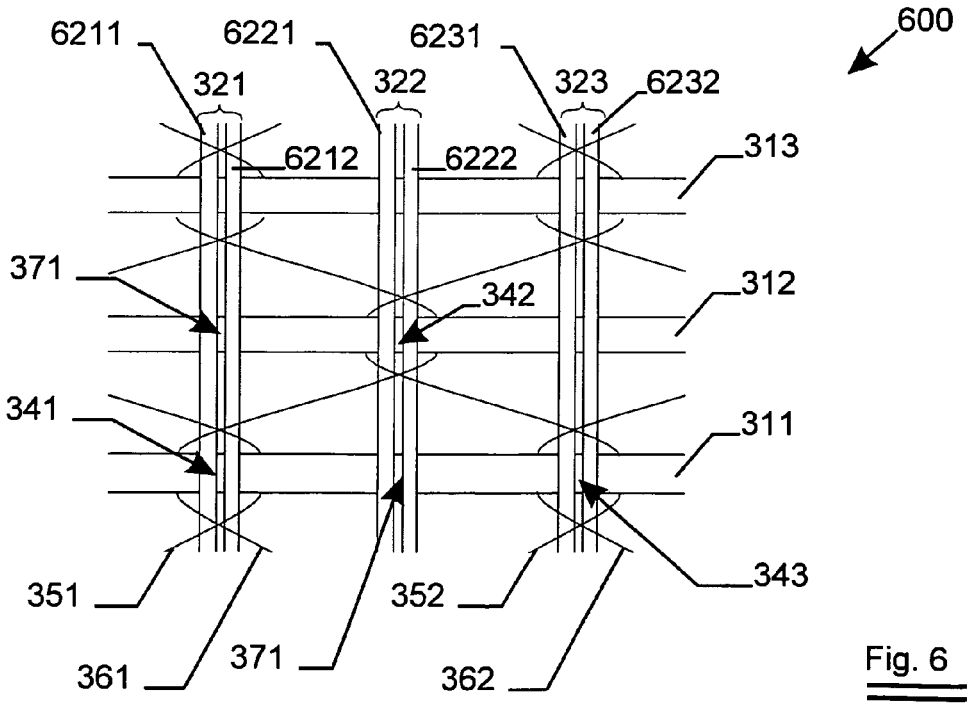

An alternative woven fabric 600 as subject of the invention is shown in FIG. 6. This fabric 600, for which reference numbers used in FIG. 3 correspond with identical features in FIG. 5, differs from the woven fabric of FIG. 3 by having warp elements which comprise on its turn more than one, e.g. such as shown two, substantially parallel metal wires or metal cords. As shown in FIG. 6, the warp element 321 comprises two essentially parallel metal wires or metal cords 6211 and 6212. The warp element 322 comprises two essentially parallel metal wires or metal cords 6221 and 6222. The weft element 323 comprises two essentially parallel metal wires or metal cords 6231 and 6232.

Figure 7A:
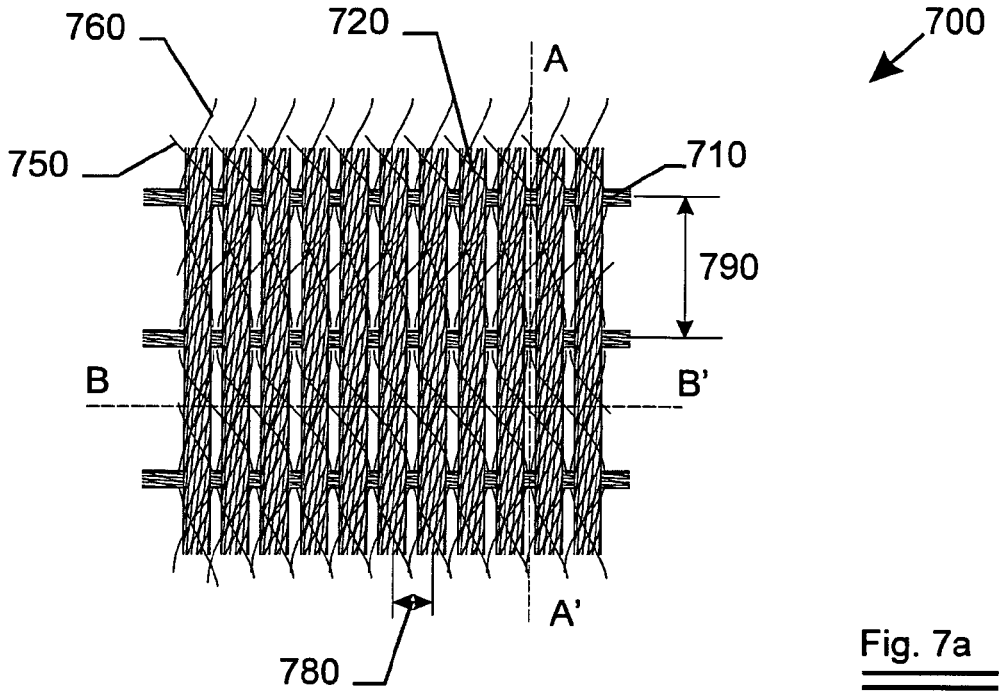
FIG. 7*a*, FIG. 7*b* and FIG. 7*c*, and FIG. 8*a* and FIG. 8*b* show schematically more in detail a preferred woven fabric as subject of the invention.
Figure 7B:
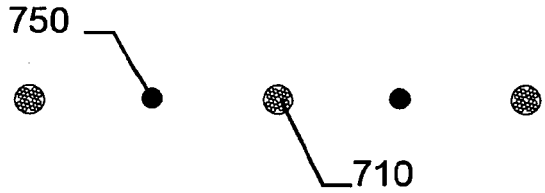
Figure 7C:
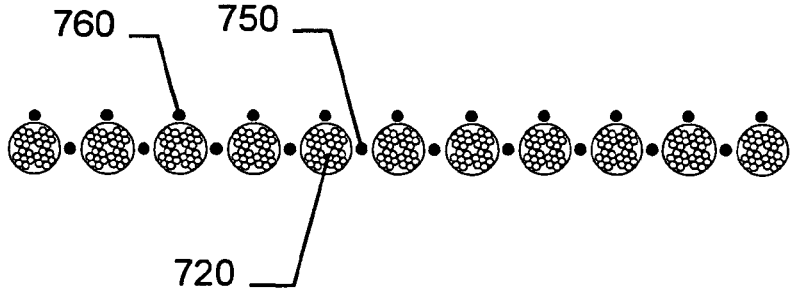

A preferred embodiment of a woven fabric as subject of the invention is shown in FIG. 7*a*, FIG. 7*b* and FIG. 7*c*. FIG. 7*a* shows schematically a perspective view of the embodiment. FIG. 7*b* shows a section of the woven fabric of FIG. 7*a* according to the plane AA'. FIG. 7*c* shows a section of the woven fabric of FIG. 7*a* according to the plane BB'. The scale of the figures may be exaggerated in order to improve the comprehensibility of the figures.

The woven fabric 700 as subject of the invention has a weaving structure as shown in FIG. 2. The warp elements 720 are steel cords from a construction 4×(0.5+6×0.44) elongation cord, provided out of high tensile steel. The weft elements 710 are steel cords having a construction 4×(7×0.30) high elongation cord provided out of high tensile steel. The binding elements from the first set of binding elements 750 and from the second set of binding elements 760 are polyamide cords having a construction "940×2×2", being a plied construction of two pairs of mutually plied single yarns, each single yarn comprising 940 polyamide filaments. Alternatively, the binding warp elements of the first set of binding elements 750 may be a polyamide cord construction of "940×2", being a plied construction of two single yarns, each single yarn comprising 940 polyamide filaments.

As an alternative for the polyamide binding elements, substantially polyaramide yarn or cord with substantially equivalent fineness may be used.

Figure 8A:
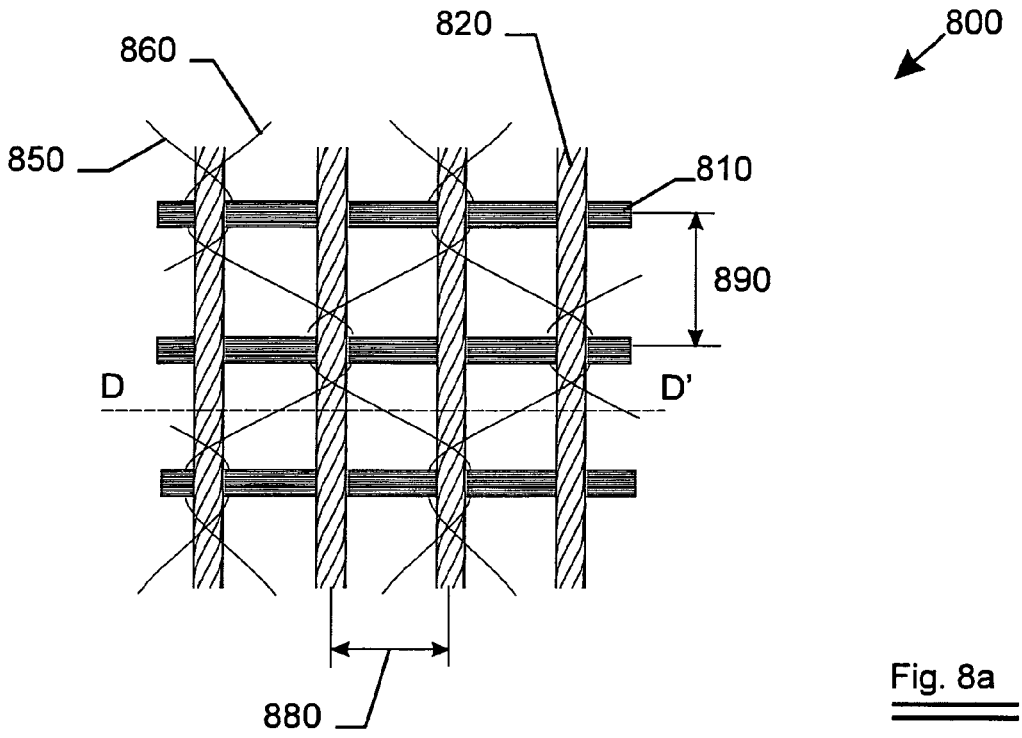
Figure 8B:
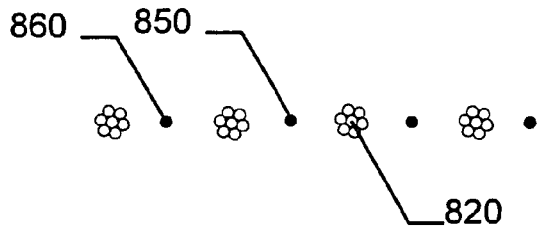

The pitch or distance 780 between the axes of two adjacent steel cord warp elements is preferably 5.5 mm. alternatively this pitch may be e.g. 7.04 mm. The pitch or distance 790 between the axes of two adjacent weft elements is preferably 20 mm An other preferred embodiment of a woven fabric as subject of the invention is shown in FIG. 8*a* and FIG. 8*b*. FIG. 8*a* shows schematically a perspective view of the embodiment. FIG. 8*b* shows a section of the woven fabric of FIG. 8*a* according to the plane DD'. The scale of the figures may be exaggerated in order to improve the comprehensibility of the figures.

The woven fabric 800 as subject of the invention has a weaving structure as shown in FIG. 3. The warp elements 820 are steel cords from a construction 0.31+6×0.30, provided out of regular steel. The weft elements 810 are preferably glass roving made from glass filaments of 7 μm to 10 μm diameter, the roving having a fineness of 2400 tex. The binding elements from the first set of binding elements 850 and from the second set of binding elements 860 are polyamide yarns having a fineness of 44 dtex. As an alternative for the polyamide binding elements, substantially polyaramide yarn or cord with substantially equivalent fineness may be used. As an other alternative, a 300 tex glass fiber yarn may be used, either a spun glass fiber yarn or a glass filament fiber yarn.

The pitch or distance 880 between the axes of two adjacent steel cord warp elements is preferably 0.25 mm. The pitch or distance 890 between the axes of two adjacent weft elements is preferably 2.5 mm.

The woven fabrics as subject of the invention may be used for reinforcing purposes in different technical applications.

Figure 9:
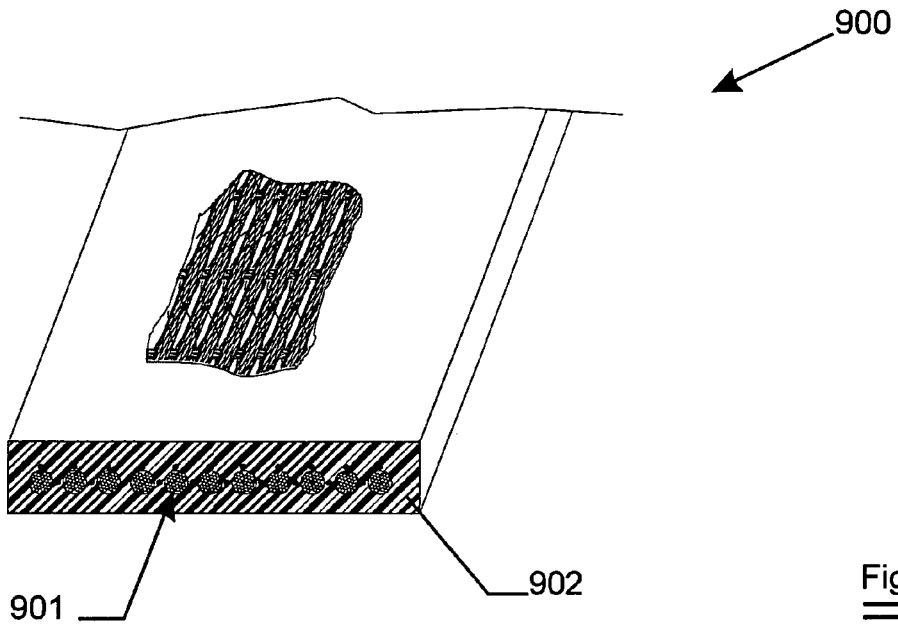
FIG. 9 shows schematically a woven fabric as subject of the invention used as a reinforcing means in a belt.

As shown in FIG. 9, the woven fabric 901, which is a fabric according to FIG. 7, but may alternatively be one of the woven fabrics out of FIG. 1, 2, 3, 4, 5, 6 or 8, is used as a reinforcing structure of a belt 900, e.g. an elevator belt or horizontal transport belt which further comprises a rubber or polymer matrix 902. Preferably the matrix 902 is a SBR rubber of NR-SBR rubber. It is understood that next to the woven fabric 901, the belt 900 may comprise additional reinforcing members.

Figure 10:
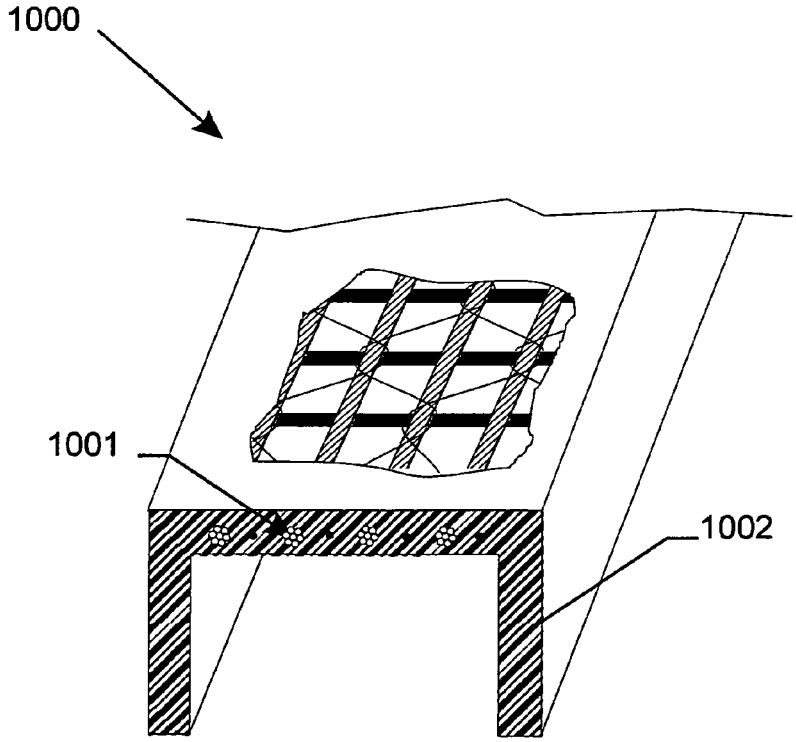
FIG. 10 shows schematically a woven fabric as subject of the invention used as a reinforcing means in an impact absorbing structure, being an impact beam.

As shown in FIG. 10, the woven fabric 1001, which is a fabric according to FIG. 8, but alternatively may be one of the woven fabrics out of FIG. 1, 2, 3, 4, 5, 6 or 7, is used as a reinforcing structure of an impact absorbing structure, such as an impact beam 1000 of a vehicle, e.g. n impact absorbing bumper beam. The impact absorbing structure 1000 further comprises a polymer matrix 1002, which is preferably polypropylene matrix, or a glass mat reinforced polypropylene matrix. It is understood that next to the woven fabric 1001, the belt 1000 may comprise additional reinforcing members. Preferably, the used glass fiber roving has a seizing, adapted to bind to the polypropylene matrix.

The invention claimed is:

1. A woven fabric comprising:

weft elements and warp elements, and at least a first set of substantially parallel binding elements present in a warp direction of said fabric, said warp elements being provided out of metal, said warp elements and said weft elements crossing at intersection points, said first set of binding elements binding said warp elements to said weft elements by a leon weave at at least a part of the intersection points, wherein each binding element of said first set of binding elements crosses more than one warp element between consecutive intersection points bound by said binding element, and wherein the total number of warp elements is less than or equal to the total number of binding elements.

2. A woven fabric according to claim 1, wherein each binding element of said first set of binding elements crosses two warp elements between consecutive intersection points bound by said binding element.

3. A woven fabric according to claim 1, wherein at at least a part of the intersection points where the warp elements and weft elements are not bound by the binding element, the warp elements and weft elements are interwoven.

4. A woven fabric according to claim 1, wherein said fabric further comprises a second set of substantially parallel binding elements present in the warp direction of said fabric, said second set of binding elements binding at least a part of said warp elements to a part of said weft elements by a leon weave at at least a part of the intersection points, each binding element of said second set of binding elements crosses at least one warp element between consecutive intersection points bound by said binding element.

5. A woven fabric according to claim 1, wherein said fabric further comprises a second set of substantially parallel binding elements present in the warp direction of said fabric, said second set of binding elements binding at at least a part of said warp elements to a part of said weft elements by a leon weave at the at least a part of the intersection points, each binding element of said second set of binding elements crosses more than one warp element between consecutive intersection points bound by said binding element.

6. A woven fabric according to claim 5, wherein said first set of binding elements and of said second set of binding elements cross an identical number of warp elements between consecutive intersection points bound by said binding elements.

7. A woven fabric according to claim 4, wherein said first set of binding elements crosses said warp elements in an opposite direction of said second set of binding elements between consecutive intersection points bound by said binding elements.

8. A woven fabric according to claim 4, wherein the number of binding elements of said first set of binding elements is less than or equal to the number of binding elements of said second set of binding elements.

9. A woven fabric according to claim 4, wherein at each of the intersection points bound by a binding element, at least a binding element of said first set of binding elements is present at a first side of the bound warp element, and a binding element of said second set of binding elements is present at an opposite side of said bound warp element.

10. A woven fabric according to claim 1, wherein said warp elements are steel cords.

11. A woven fabric according to claim 1, wherein said weft elements are steel cords.

12. A woven fabric according to claim 1, wherein said weft elements comprises more than one steel cord, all of said steel cords being substantially parallel to each other.

13. A woven fabric according to claim 1, wherein said binding elements are polyamide cords or polyamide yarns.

14. A woven fabric according to claim 1, wherein said binding elements are glass fiber yarns.

15. A woven fabric according to claim 1, wherein said binding elements are polyaramide cords or polyaramide yarns.

16. A method of using a woven fabric, comprising:

providing the woven fabric comprising weft elements and warp elements, said warp elements being provided out of metal, said warp elements and said weft elements crossing at intersection points, said fabric further comprising at least a first set of substantially parallel binding elements present in a warp direction of said fabric, said first set of binding elements binding said warp elements to said weft elements by a leon weave at at least a part of the intersection points, wherein each binding element of said first set of binding elements crosses more than one warp element between consecutive intersection points bound by said binding element, and wherein the total number of warp elements is less than or equal to the total number of binding elements; and using the woven fabric as a reinforcement for a polymer article.

17. The method of using a woven fabric as in claim 16, wherein said polymer article is a polymer belt.

18. The method of using a woven fabric as in claim 17, wherein said polymer belt is a rubber belt.

19. The method of using a woven fabric as in claim 16, wherein said polymer article is an impact absorbing structure.

* * * * *